United States Patent [19]

Vakil

[11] 4,406,134

[45] Sep. 27, 1983

[54] TWO CAPILLARY VAPOR COMPRESSION CYCLE DEVICE

[75] Inventor: Himanshu B. Vakil, Schenectady, N.Y.

[73] Assignee: General Electric Company, Schenectady, N.Y.

[21] Appl. No.: 323,851

[22] Filed: Nov. 23, 1981

[51] Int. Cl.[3] ..... F25B 1/00

[52] U.S. Cl. ..... 62/114; 62/504; 62/511; 62/527

[58] Field of Search ..... 62/114, 511, 527, 504

[56] References Cited

U.S. PATENT DOCUMENTS

| | | | |
|---|---|---|---|
| 2,404,010 | 7/1946 | Urban | 62/511 |
| 3,044,273 | 7/1962 | Lower et al. | 62/511 |
| 3,150,502 | 9/1964 | Tucker | 62/511 |
| 3,162,021 | 12/1964 | Brody | 62/511 |
| 3,285,030 | 11/1966 | Coyne | 62/511 |
| 3,638,447 | 2/1972 | Abe | 62/511 |
| 4,306,421 | 12/1981 | Gucwa, Jr. et al. | 62/511 |

*Primary Examiner*—Ronald C. Capossela

*Attorney, Agent, or Firm*—Richard J. Traverso; James C. Davis, Jr.; James Magee

[57] ABSTRACT

A vapor compression cycle device is provided using two capillaries to maximize efficiency benefits due to capillary flowrate regulation thus permitting the working fluid flowrate to depend on the level of liquid working fluid accumulated at the condenser.

10 Claims, 1 Drawing Figure

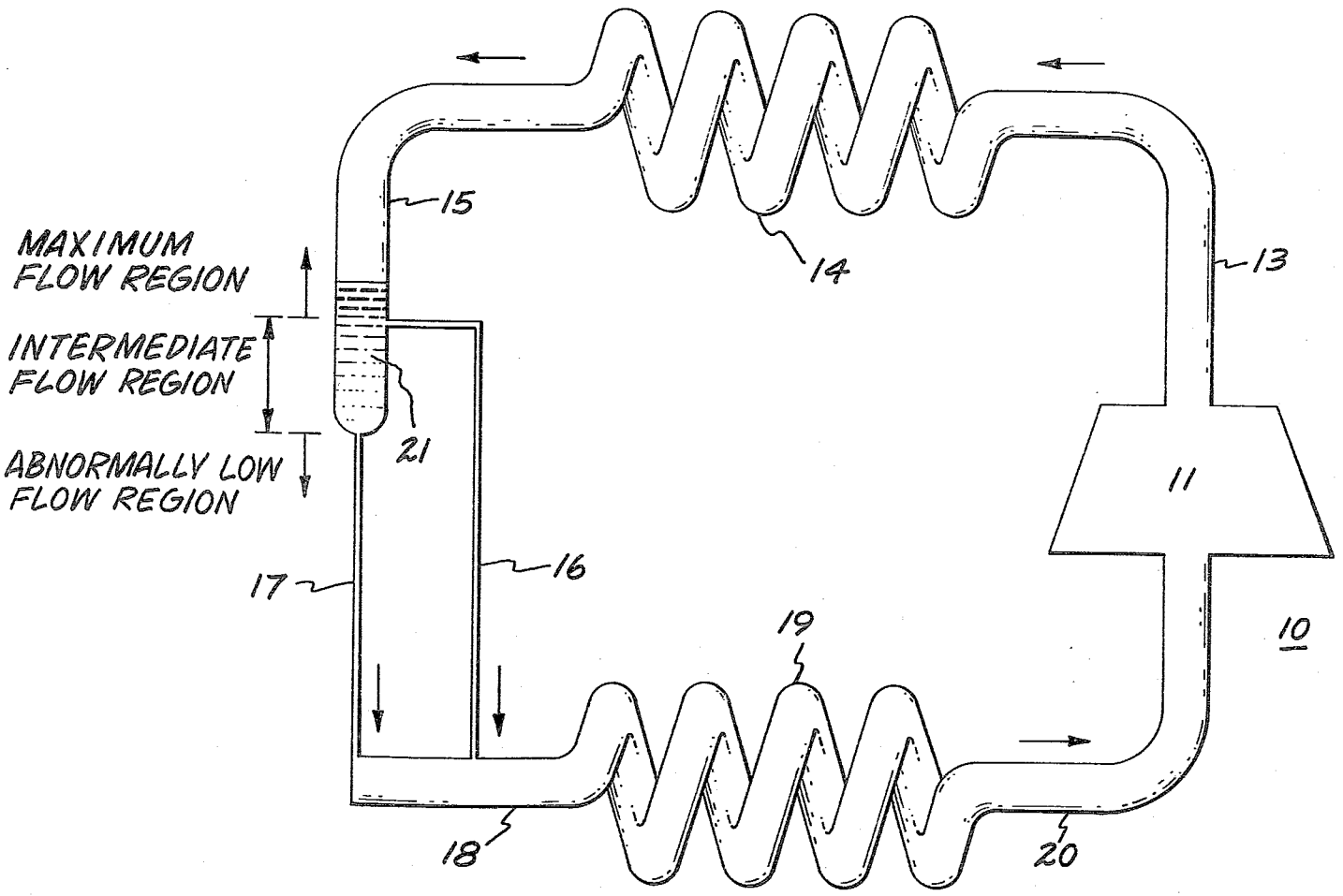
10
11
13
14
15
16
17
18
19
20
21
MAXIMUM FLOW REGION
INTERMEDIATE FLOW REGION
ABNORMALLY LOW FLOW REGION

TWO CAPILLARY VAPOR COMPRESSION CYCLE DEVICE

This invention relates to a vapor compression cycle device and to a method of modulating working fluid flow rate and, more particularly, to such a device incorporating two capillaries, a first capillary connected at the termination of the condenser outlet tube and a second capillary connected upstream from the main capillary so that the first capillary passes liquid working fluid and the second capillary can pass either liquid or vapor working fluid depending on the volume of liquid which has accumulated at the condensor outlet. When the volume of liquid accumulated becomes large the level of said liquid rises above the inlet of the second capillary at which time the second capillary begins to pass liquid insted of vapor and consequently the mass flow rate of working fluid passing through the second capillary increases and the level of liquid at the condensor outlet is regulated.

In conventional vapor compression cycle device such as a heat pump a working fluid is circulated through an expansion device into an evaporating heat exchanger where the working fluid absorbs heat. The heat vaporizes the working fluid liquid, and the resulting vapor is then circulated by a suitable compressor through a condensing heat exchanger where the vapor condenses into a liquid as heat is given off. The cycle is then repeated as the working fluid is recirculated through the system.

Various U.S. patents have described means and methods for modulating the capacity of vapor compression cycle devices. Among these are U.S. Pat. Nos. 2,807,943, 2,942,725, 4,003,215, 4,179,898, 4,217,760, 4,218,890, 4,283,919, 4,290,272. The above patents generally include means to modulate the capacity of the device to absorb and deliver heat, herein referred to as device thermal capacity, in response to variable heating and cooling demands in order to maximize efficiency. This is usually accomplished by regulating the amount of multi-component working fluid allowed to flow from a first accumulator through an evaporator to a second accumulator located at a compressor inlet. This results in a change in the molar flow rate through the compressor and thus a change in device thermal capacity.

For the efficient operation of a vapor compression cycle device, it is necessary to ensure that the expansion device, usually in the form of a capillary, is supplied with working fluid liquid mostly free of vapor and at the same time to ensure that there is not an excess of liquid causing it to back-up into the condenser. In either of these circumstances the vapor compression cycle device becomes less efficient.

During one specific set of conditions which occurs for example during start-up of the vapor compression cycle device during periods of high cooling demand, the evaporator is warm and the compressor pumps large amounts of working fluid to the condenser.

In the absence of subcooling of the inlet-liquid, the flowrate through a single capillary is fixed at a given condenser pressure. Consequently, the capillary is unable to pass all of the condensed liquid to the evaporator and thus the working fluid accumulates in the condenser as a liquid. This has a detrimental effect on both the condenser which is now flooded and the evaporator which is now starved.

At other times, especially towards the end of a cycle, the evaporator temperture drops as does the flow of compressed working fluid.

As a result, the liquid in the condenser drains and eventually vapor is allowed to pass through the expansion device or capillary. This leads to a loss of efficiency since this vapor performs no useful cooling. These two extreme requirements receive a compromise in the selection of a capillary size which corresponds to the average flowrate during average conditions so as to avoid having either a surplus or a deficit of liquid working fluid at the inlet of the expansion device. Unfortunately, this balance can be achieved for only one set of operating conditions. In typical operation of a vapor compression device cycle, the capillary flow is usually lower than needed during early parts of the cycle and higher than desirable during the latter part of the cycle.

The ability to regulate the flowrate through the expansion device would improve the device efficiency by adapting to various operating conditions without incurring the disadvantages mentioned above.

An object of this invention is to provide a simple, maintenance free, inexpensive solution to the problem of optimizing the flow characteristics of an expansion device in a vapor compression device.

A further object of this invention is to provide means for maintaining a proper accumulation of liquid at the capillary inlet in vapor compression devices that incorporate capacity modulation.

The present invention discloses a method for modulating the working fluid flowrate in a vapor compression cycle device which comprises compressing a working fluid vapor in a compressor, condensing working fluid vapor in a condensing heat exchanger, passing a portion of the working fluid from said condensing heat exchanger through a first expansion device positioned so as to pass working fluid from the lower most portion of the output of said condensing heat exchanger or its termination, passing a portion of the working fluid from said condensing heat exchanger through a second expansion device positioned so as to pass working fluid from a region of the condensing heat exchanger output which is upstream or higher than the inlet to said first expansion device, passing working fluid from said expansion device to an evaporating heat exchanger or to an evaporating heat exchanger and associated inlet tube of said compressor, evaporating the working fluid in the evaporative heat exchanger, and finally compressing the working fluid vapor for recirculation.

The present invention also discloses a vapor compression cycle device comprising a closed working fluid circuit, a working fluid in the circuit, said closed circuit comprising a compressor, a condenser, a first expansion device having an inlet at the termination or lower most portion of the outlet from said condenser, an evaporator connected to the outlet of said first expansion device, and the outlet of said evaporator connected to said compresssor and a second expansion device having an inlet positioned upstream from said inlet of said first expansion device, and an outlet connected intermediate the inlet of said evaporator and said compressor.

It is well known that the mass flowrate of a fluid through a capillary for a given pressure drop depends to a great extent on the amount of vapor entering the capillary; even a small fraction of the total flow entering as vapor greatly reduces the total flowrate. The present invention uses two separate capillaries connecting the condenser outlet to the evaporator inlet. In some refrigerator configurations a molecular sieve dryer can preceed the capillaries. According to the invention, the condenser output tube has one capillary attached to the bottom of it as is the current practice. In addition to this capillary, there is another one joined to the condenser tubing slightly higher and upstream from the first, a typical distance may be ½ inch to 1 inch. The capillaries may both terminate at the evaporator inlet or one may terminate downstream partway through the evaporator or at the compressor inlet.

The operation of this device during a typical on/off cycle in a refrigerator is described below.

The bottom capillary is sized to give the desired minimum flowrate at the end of the cycle. The upper or trim capillary is sized such that when liquid working fluid enters during the early part of the on-cycle, it permits a sufficiently high flowrate to rapidly decrease the excess liquid flooding the condenser. This higher flowrate also permits more liquid to spill out into the evaporator or into the suction line in heat exchange relationship with the main capillary thereby cooling the capillary during the early part of the transient. The moment this higher than normal flow causes the liquid level to fall below the inlet of the upper capillary, its throughput decreases rapidly as more vapor enters it and the system operates with the lower flowrate suitable for the mid and late part of the cycle. The two capillaries together serve as a type of level control by adjusting the flowrate according to whether the top capillary receives vapor or liquid. Over typical operating inlet and outlet pressures, the system has three different flowrate regions:

1. A maximum flowrate region occurring when both capillaries are flooded with liquid working fluid.

2. A minimum flowrate region occuring when the top capillary is substantially devoid of liquid and the bottom capillary receives part vapor indicating an abnormally low amount of condensed liquid.

3. A variable flowrate range from the maximum flowrate down to the design minimum flowrate with flowrate decreasing steadily as liquid level drops and more vapor enters the top capillary while the bottom capillary is flooded.

The present invention may be used in a single or multicomponent refrigerant vapor compression device regardless of whether capacity modulation is used. It can have a major impact on the transient performance of the device and on its sensitivity to the refrigerant charge and to the capillary conductance.

The various working fluids that can be employed are well known in the art. Single or multicomponent working fluids may be used. Preferred are fluorocarbon working fluids for example dichlorofluoromethane and monochlorodifluoromethane. Examples of such fluorocarbon working fluids can be selected from those described in U.S. Pat. No. 4,003,215 which is herein incorporated by reference.

The present invention may also be used to control the flowrate in devices incorporating capacity modulation. When the modulation is achieved either by, for example, ejecting the liquid from the high pressure accumulator or by taking up vapor from the condenser, the liquid inventory upstream of the capillary is significantly altered. It is desirable, therefore, to increase the flow through the capillary temporarily during an increase in capacity and to reduce it during a decrease.

A more thorough understanding of the present invention may be obtained by reference to the accompanying drawing wherein:

The FIGURE is a schematic illustration of a vapor compression cycle device constructed in accordance with an embodiment of the present invention;

In the FIGURE there is shown a vapor compression cycle device 10 in accordance with the present invention. Device 10 has a compressor 11 for the working fluid. Tube 13 connects compressor 11 to the inlet side of condensing heat exchange 14. Tube 15 connects the outlet side of condensing heat exchanger 14 first to a trim capillary 16 then to the main capillary 17. Tube 18 connects the outlet of both capillaries to an evaporating heat exchanger 19. A tube 20 connects the outlet side of exchanger 19 to compresser 11. Thus a closed system is provided containing a working fluid that flows cyclically through the entire system.

The condenser outlet tube 15 terminates in a main capillary 17. A second trim capillary 16 is connected to the condenser outlet tube 15 upstream from its termination. The working fluid flowrate will vary depending on the amount of working fluid if any which has accumulated as a liquid in the condenser outlet tube. The maximum working fluid flowrate occurs when both the main and trim capillaries are passing liquid and no vapor. As the liquid level drops below the trim capillary inlet on the condenser outlet tube the trim capillary begins to pass vapor which results in a decrease in mass flowrate. The trim capillary can be positioned and sized so as to obtain a maximum mass flowrate which corresponds to the maximum transient device performance anticipated for the particular application and to optimize efficiency.

The above-described embodiments are intended to be exempletive only and not limiting, and it will be appreciated from the foregoing by those skilled in the art that many substitutions, alterations and changes may be made to the disclosed structures and methods without departing from the spirit or scope of the invention.

What is claimed as new and desired to be secured by Letters Patent of the United States is:

1. A method for modulating the working fluid flowrate in a vapor compression cycle device which comprises compressing a working fluid vapor in a compressor, condensing working fluid vapor in a condensing heat exchanger, passing a portion of the working fluid from said condenser heat exchanger through a first expansion device positioned so as to pass working fluid from the lower most portion of the output of said condensing heat exchanger or its termination, passing a portion of the working fluid from said condensing heat exchanger through a second expansion device positioned so as to pass working fluid from a region of the condensing heat exchanger output which is upstream or higher than the inlet to said first expansion device, passing working fluid from said expansion devices to an evaporating heat exchanger, or to an evaporating heat exchanger and associated inlet tube of said compressor, evaporating the working fluid in the evaporative heat exchanger, and finally compressing the working fluid vapor for recirculation.

2. A method of modulating the working fluid flowrate of a vapor compression cycle device which comprises compressing a working fluid in a compressor, circulating the working fluid vapor to a condenser, circulating a portion of the working fluid from the condenser to a first capillary connecting the lowest point or termination of the condenser output tube to an evaporator, circulating a portion of the working fluid from the condenser to a second capillary connecting a region slightly higher or upstream from said first capillary inlet to said evaporator or associated inlet tube of said compressor, circulating the working fluid from said capillaries to said evaporator or said evaporator and compressor inlet tube, evaporating the working fluid in said evaporator, circulating the working fluid from the evaporator to said compressor so that the flow rate of the working fluid from said condenser to and through said evaporator is dependent on the level of liquid working fluid accumulated at the output of said condenser.

3. A method of modulating the working fluid flowrate of a vapor compression cycle device as in claim 2 in which the flowrate of the working fluid is increased when the liquid working fluid level at the output of said condenser rises above the inlet of said second capillary, and the flowrate of working fluid is decreased when the liquid working fluid level at the output of said condenser falls below the inlet to said second capillary.

4. A method of modulating the working fluid flowrate of a vapor compression cycle device as in claim 2 wherein the working fluid is a multicomponent working fluid mixture.

5. A method of modulating the working fluid flowrate of a vapor compression cycle device as in claim 4 wherein the working fluid is a dichlorodifluoro methane or a monochlorodifluoromethane.

6. A method of modulating the working fluid flowrate of a vapor compression cycle device as in claim 2 wherein said vapor compression cycle device incorporates means for capacity modulation.

7. A vapor compression cycle device as in claim 6 also comprising means for capacity modulation.

8. A vapor compression cycle device as in claim 6 wherein the working fluid is a multicomponent working fluid mixture.

9. A vapor compression cycle device comprising a closed working fluid circuit, working fluid in the circuit, said closed circuit comprising a compressor, a condenser, a first expansion device having an inlet at the termination or lower most portion of the outlet from said condenser, an evaporator connected to the outlet of said first expansion device, and the outlet of said evaporator connected to said compressor and a second expansion device having an inlet positioned upstream from said inlet of said first expansion device connected to the outlet of said condenser, and an outlet connected between the inlet of said evaporator and said compressor.

10. A vapor compression cycle device as in claim 9 wherein the mixture is a multicomponent fluorocarbon working fluid.

* * * * *